United States Patent [19]

Izenour

[11] Patent Number: 4,843,529

[45] Date of Patent: Jun. 27, 1989

[54] STAGE LIGHTING APPARATUS

[75] Inventor: George C. Izenour, Stony Creek, Conn.

[73] Assignee: Lehigh University, Bethlehem, Pa.

[21] Appl. No.: 133,316

[22] Filed: Dec. 16, 1987

Related U.S. Application Data

[62] Division of Ser. No. 909,498, Sep. 19, 1986.

[51] Int. Cl.[4] ..... F21V 13/00

[52] U.S. Cl. ..... 362/284; 362/268; 362/283; 362/301; 362/324; 350/623

[58] Field of Search ..... 362/268, 269, 281, 284, 362/272, 293, 294, 301, 324, 283; 350/623, 626

[56] References Cited

U.S. PATENT DOCUMENTS

| | | | |
|---|---|---|---|
| 478,510 | 7/1892 | Hunter . | |
| 1,607,688 | 11/1926 | Perrin et al. . | |
| 1,828,924 | 10/1931 | Chardell et al. . | |
| 2,909,652 | 10/1959 | Pratt . | |
| 2,950,382 | 8/1960 | Hatch | 362/281 |
| 3,571,588 | 3/1971 | Hilzen . | |
| 3,609,339 | 9/1971 | Smith . | |
| 3,845,351 | 10/1974 | Ballmoos et al. | 315/293 |
| 4,010,361 | 3/1977 | Latterman et al. | 84/464 R |
| 4,260,217 | 4/1981 | Traeger et al. | 350/1.2 |
| 4,364,535 | 12/1982 | Itoh et al. | 248/123.1 |
| 4,521,834 | 6/1985 | Orr | 362/139 |
| 4,563,567 | 1/1986 | Geffroy et al. | 219/121 LU |
| 4,598,345 | 7/1986 | Kleeman | 362/272 X |
| 4,663,698 | 5/1987 | Tomlinson | 362/301 X |

FOREIGN PATENT DOCUMENTS

| | | |
|---|---|---|
| 0088501 | 9/1983 | European Pat. Off. . |
| 0120329 | 2/1984 | European Pat. Off. . |
| 1180160 | 10/1964 | Fed. Rep. of Germany . |

*Primary Examiner*—Stephen F. Husar

[57] ABSTRACT

A stage lighting unit including a beam former and beam redirector. The beam redirector allows for the remote control of beam over a large expanse of the stage.

11 Claims, 3 Drawing Sheets

FIG. 3
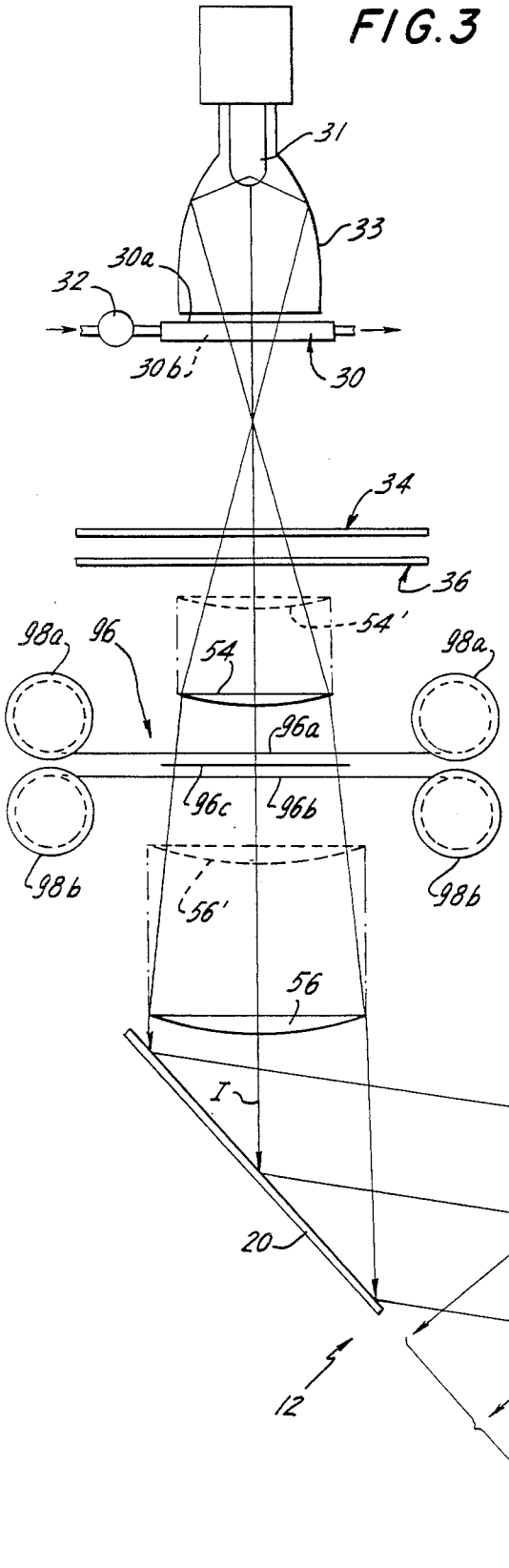
FIG. 5
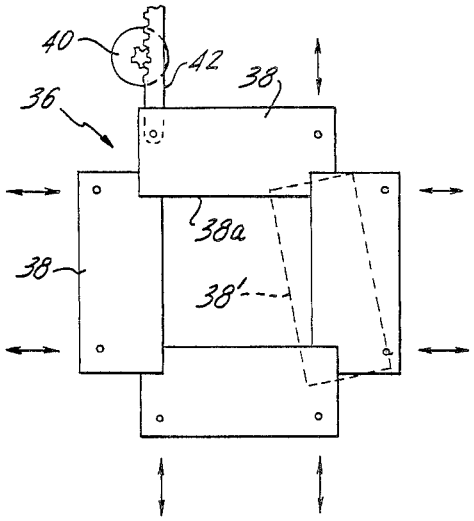
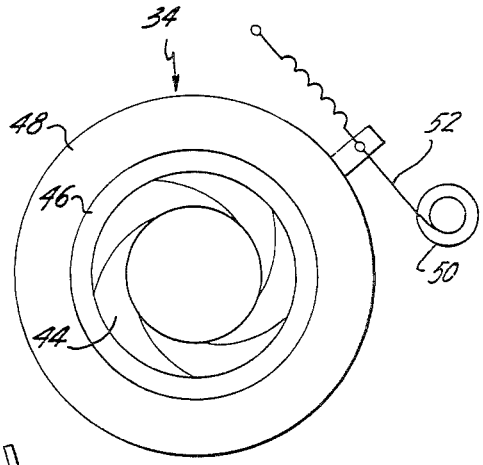
FIG. 6

STAGE LIGHTING APPARATUS

This is a division of application Ser. No. 06/909,498 filed Sept. 19, 1986.

The present invention relates to apparatus for providing spot lighting for a stage used in the performing arts or studios for movies and television.

A spot light for stage lighting typically involves many adjustments. In addition to controlling the lamp brightness, the adjustable elements commonly include selective or replaceable color filters, a gate or an iris to control the shape of the beam, lenses to determine whether the beam is sharp or diffuse and whether the angle of the beam is relatively narrow or wide, and a mount with adjustments for aiming the shaped beam.

For providing stage lighting of a scene, a set of stage lighting units, or spot lights, are aimed at particular areas of a stage, reaching those areas along directions chosen to produce desired effects. The spot lights can be readjusted by stage hands between scenes, often requiring ladders and scaffolding. In a theater, those adjustments have to be made within the limited available time. Moreover, the labor of stage hands for this purpose can be quite expensive. As an alternative, many spot lights can be provided (600 spot lights in one instance) so that they can be adjusted once in advance of a production, one set for each scene. Such redundancy is also quite expensive and can only be used for spacious stages. Adjustment of stage lighting units by remote control has been proposed but that has proved to be impractical.

In one aspect of the invention, a novel stage lighting unit is provided that is particularly suitable for remote control, either manually or by a program controller, to form a beam of adjustable characteristics and to aim the beam from an installed lighting unit to particular parts of a large expanse of the stage along a wide range of angular directions. Conversely, where a number of such lighting units are installed at distributed locations, a beam of light can be directed along a desired direction toward any particular area of the stage by using an appropriately located stage lighting unit.

Novel stage lighting units meeting these requirements should be suitable for installation above the stage, both along the sides of the stage and across the proscenium, and they may be installed at various elevated locations in front of the stage. Each stage lighting unit includes a beam former that is stationary and vertical, and it includes an adjustable device for redirecting the beam from the beam former, to aim the beam at widely distributed areas of the stage.

In the exemplary stage lighting unit detailed below, the beam redirecting device is adjustably rotatable about a vertical axis to provide an azimuth adjustment and it is also adjustable to aim the beam at various angles of elevation to reach widely distributed areas of the stage. Correspondingly, by using a lighting unit installed at any of a widely distributed range of locations, a beam can be aimed toward any particular part of the stage along a desired direction. The adjustment axis of the beam redirector is "vertical" in a broad sense, including a practical range of deviations from the true vertical.

The adjustable beam redirecting means in the novel exemplary lighting unit detailed below includes first and second mirrors acting in succession on the formed beam. These mirrors are mounted as a unit that is adjustable about the axis of the formed beam; and at least the second of the mirrors is adjustable about an axis that is perpendicular to a plane containing both the axis of the formed beam and the axis of the output beam as variably redirected.

The two-mirror beam redirecting device is effective with respect to beams having various characteristics, whether wide of narrow and whether sharp or diffusely focussed, in a manner that essentially preserves the cross-sectional shape of the beam. Stage lighting units of the illustrative construction are particularly effective in reaching widely distributed parts of a stage, and in providing beams from lighting units at selected locations to reach any part of the stage from widely varied directions.

As will be seen, the illustrative stage lighting unit is well adapted for adjustment by remote control. The beam former includes motors for adjusting the various devices that determine the characteristics of the beam, and normally two motors are included in the adjustable beam redirector. It is important to maintain a known, established relationship between the controlled device and both a position indicator of a manual control and a program controller. There is no concern for maintaining such relationship where the adjustment is self-locking or where the adjustable device is balanced about an axis. However, remote-controlled gravitationally unbalanced devices do tend to drop out of adjustment when the torque of their adjustment motors is interrupted. In the illustrative lighting unit, the beam redirector is prominently unbalanced in relation to its axis. However, its adjustment is retained despite interruption of power to its actuating motor because its adjustment axis is vertical, being gravitationally neutral.

A further aspect of this invention relates to noise that might develop in motors needed for operating adjustable parts of a stage lighting unit under remote control. Avoidance of noise is of critical concern in stage equipment, because any noise that may develop during a quiet scene could be a serious audible distraction.

The adjustment of the beam redirector in the illustrative lighting unit involves operating a gravitationally unbalanced mass which ordinarily would give rise to a noise problem. However, because the axis of the beam redirecting unit is vertical, the motor is not exposed to load peaks in the course of operating the beam redirector, and the noise problem is minimized; noise related to load peaks is avoided.

Heat of the beam in the beam former tends to heat the blades of an iris and the blades of a gate, so that some warping of blades should be anticipated. Here, where the blades of an iris and the blades of a beam-shaping gate move horizontally during adjustment, i.e. transverse to the vertical axis of the beam in the beam former, the blades are supported and guided from below. Any guiding or blade-retaining parts above an iris or a gate can accordingly be spaced relatively far from the guiding support below the blades. It is practical to allow ample clearance between a blade-guiding lower support and an upper guide (if any) to allow for warping of the blades.

It is contemplated that the novel general-purpose stage lighting units will include relatively large lamps. The infrared energy in the output of a large lamp could damage or destroy devices commonly included in a stage lighting unit, notably beam-shaping devices such as a gate or an iris and a color filter. Use of a "cool" reflector to form the lamp's output into a beam is partially effective in extracting some of the beam's infra-red, and use of a heat filter across the beam is also useful in providing a "cool beam." The heat filter may be a "hot mirror" having a heat-reflecting coating transparent to visible light. Quite separately, an infra-red absorber may be interposed across the beam in the form of a chamber made of clear glass (for example) containing heat absorbing liquid such as water which also has the property of extracting infra red. The stage lighting unit described in detail below utilizes both of these infra-red extracting devices for providing a cool beam to the other parts of the beam former. The infra-red absorbing liquid acts additionally to keep the heat-reflecting coating cool.

A general-purpose stage lighting unit that is suitable for remote control should include a changeable color filter. A color wheel can provide only a limited number of colors, a selected filter being used for any particular scene. The disclosed lighting unit is equipped with a color filter having multiple superposed filters that are related to each other to provide a vast range of colors and hues and are operable by remote control.

Accordingly, the stage lighting unit described in detail below and shown in the accompanying drawings involves various aspects of distinct value in stage lighting apparatus. That exemplary apparatus includes a stationary beam former providing a substantially vertical formed beam former that is vertical, together with a beam redirector that is adjustable about the downward directed axis of the formed beam for aiming the beam to selected areas over a large expanse of a stage. The two-mirror beam redirector of the illustrative stage lighting unit represents a further distinctive aspect of the invention. The exemplary stage lighting unit further includes highly effective means for extracting infra-red from the beam and it includes a color filter capable of providing a wide range of colors and hues under remote control. The stationary beam former provides a horizontal guiding support below blades of a beam shaper, tolerating heat-induced warpage of the blades.

In the drawings:

FIG. 3 is a diagrammatic illustration of the optical parts of the stage lighting unit of FIG. 2;

Figure 2:
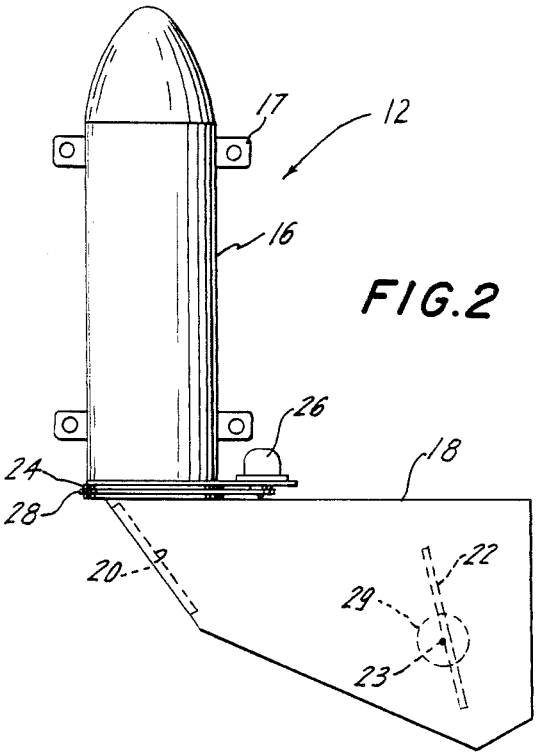
FIG. 2 is a lateral view of one of the illustrative stage lighting units of FIG. 1.
Figure 7:
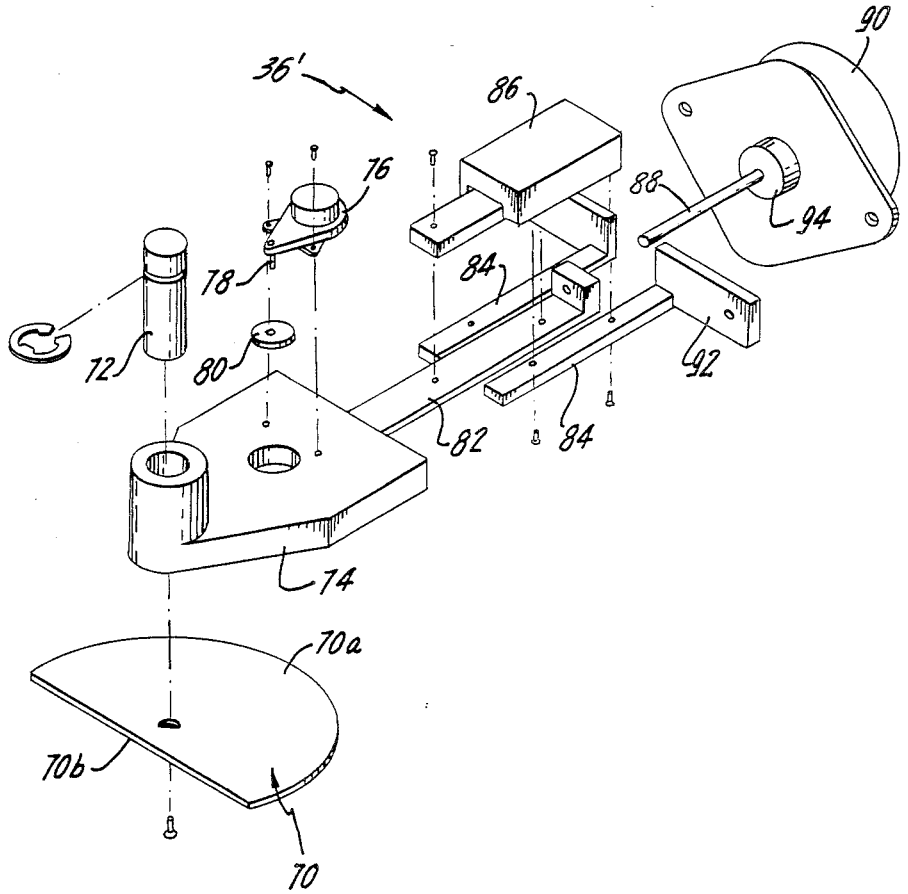

FIGS. 5 and 6 are top plan views of alternative beam shapers for the stage lighting unit of FIGS. 2 and 3, FIG. 5 representing a multiple-blade gate and FIG. 6 representing a conventional iris; and FIG. 7 is an exploded perspective of one blade of a gate for the lighting unit of FIGS. 2 and 3, a multiple-blade gate in accordance with FIG. 7 being an alternative for that of FIG. 5.

Figure 1:
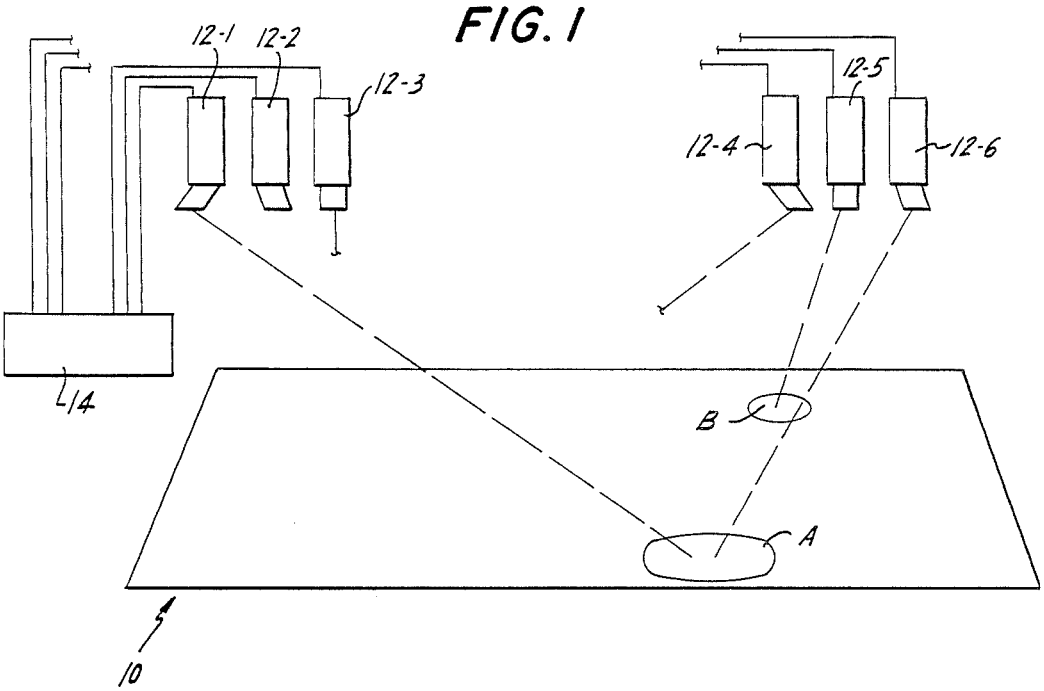
FIG. 1 is a perspective view of a stage equipped with a number of novel stage lighting units, embodying features of the invention.

FIG. 1 is a diagram showing a stage 10 with a row of lighting units 12-1, 12-2 . . . 12-5 and 12-6 supported at stationary locations above the front edge of the stage. Additional rows of lights (not shown) are installed at other locations as is customary for this kind of conventional stage lighting units. Stage lighting unit 12-1 at the left is adjusted so that its beam is aimed along a prominently angled path to area A of the stage. Stage lighting unit 12-6 at the right is also adjusted to provide a prominently angled beam reaching area A, but from a very different direction. Stage lighting unit 12-5 directs its beam along a direction angled to the rear of the stage to area B. The other stage lighting units are adjusted to direct their beams at chosen areas of the stage, along directions that are determined by the relative locations of the stage lighting units and the illuminated areas. For any given scene (or part of a scene) certain stage lighting units may be turned off, e.g. unit 12-2.

Control apparatus 14 is provided to adjust the stage lighting units from a remote location. This includes manual controls for initially setting up the lights for any production, scene by scene, and it includes a program controller for readjusting the stage lighting units for the successive scenes of a performance. The manual adjustments are represented scene by scene in the memory of the program controller. The many adjustments of each stage lighting unit are activated by suitable motors in the lighting units, being stepping motors or servo motors or any of the other motors used in program-controlled apparatus. Accordingly, all the lighting readjustments for each scene—sometimes during a scene—are carried out concurrently and speedily and at virtually no labor cost. Redundant lighting units for use in successive groups, a separate pre-adjusted group for each scene, are replaced by a single group of lighting units sufficient for the most elaborately lit scene.

Each lighting unit has many remote-controlled motors, as will be seen from the details described below, sixteen motors for example. Providing such control is well within the capability of a computer-type program controller for many lighting units each having many adjustments.

As seen in FIG. 2, an illustrative stage lighting unit 12 includes a beam forming unit 16 that is stationary when installed. Brackets 17 symbolically represent any suitable means for mounting the stage lighting unit at a chosen location in a stationary manner. Beam former 16 provides a beam directed vertically downward. The beam former imparts all of the desired beam characteristics so that the projected beam is wide or narrow, it is focussed sharply or it is diffuse, its outline is controlled, and its color is determined by a changeable filter.

The downward-directed beam from beam-former 16 is aimed in the desired direction by beam-redirecting means 18 that is rotatable about the vertical axis of the beam from the beam former 16. In the apparatus shown, the beam redirecting means is a unit that contains mirrors 20 and 22 and is supported by bearing 24 on beam former 16. Bearing 24 may be of any suitable design, for example of the ball bearing type having an inner race fixed to unit 16 and an outer race fixed to unit 18, the inner race providing a wide opening for the beam of light leaving beam former 16 and entering the beam redirector 18.

Beam redirector 18 is rotated about its bearing axis by motor 26 that is supported by an integral portion of beam former 16. Motor 26 and each of the other motors may be a pulse-responsive stepping motor or a synchro or a hydraulic drive with a position encoder, or any other motive means used in program-controlled apparatus. Motor 26 is coupled to beam redirector 18 by belt 28, as part of a toothed drive coupling to maintain a positive relationship between unit 18 and motor 26.

Mirror 20 is fixedly mounted in unit 18. Mirror 22 is adjustable about a shaft (not shown) that provides a horizontal axis 23 midway between its top and bottom edges. Mirror 22 is operated by a suitable motor 29 under remote control.

FIG. 3 represents the beam forming and redirecting components of stage lighting unit 12. Lamp 31 is mounted in an ellipsoidal reflector 33 to direct a beam of substantial cross-section through filter 30. Reflector 33 may be a "cool" reflector, having a dichroic coating on its inner surface effective to reflect visible light selectively while allowing the infra-red portion of the spectrum to penetrate into the wall (if metal) or through the wall of the reflector (if of glass).

Filter 30 may be a "hot mirror", having a dichroic coating 30*a* that reflects infra red in the beam while being transparent to visible light. Filter 30 may alternatively or additionally incorporate an infra-red absorber, especially a chamber 30*b* of liquid such as water that is transparent to visible light but absorbs the infra-red component of the beam. When filter 30 contains a liquid coolant, it is equipped with circulating means 32 and a remote heat dissipator (not shown) to transfer heated liquid from filter 30 and to keep it supplied with cooled liquid. Where filter 30 has both a coating 30*a* and a chamber containing cooling liquid, the latter serves the dual functions of extracting infra-red from the lamp output and cooling cool coating 30*a*, protecting it from deterioration that might result from high temperatures. The circulating liquid represents a medium that is especially effective for keeping filter 30 cool; but in addition, the inherent quietness of circulating liquid apparatus for removing the heat extracted from the light beam is of particular value in stage lighting apparatus. Such cooling is highly effective, yet it avoids distracting noise.

The rear of ellipsoidal reflector 33 may also be cooled, to maintain the dichroic filter on the reflector cool and thereby extend its useful life.

The extraction of infra-red from the output of the lamp is provided to avoid overheating and heat-induced warping of beam-modifying parts of the beam former, notably a beam shaping device (iris or gate) and a color filter. Customary cooling devices may be used to remove the heat developed in the lamp and its electrical connections.

Stage lighting unit 12 is equipped with an iris 34 and a multiple-blade gate 36, for establishing the outline of the beam. Both of these devices are part of the apparatus, both being available but being used as alternatives. Each of these devices includes a supporting plate as a lower guide for the beam-shaping blades; and because the beam former has a vertical axis, an underlying support could suffice. It may be desirable for the blades to be loosely retained in position by an additional overlying guide. However, because the blades need not be confined between close opposite guides, ample space can be allowed for the blades to remain operative even if they should become warped because of residual infra-red energy in the intercepted beam.

FIG. 5 shows one form of beam-shaping gate. It includes four blades 38, each of which is guided by an underlying support plate. Eight motors are mounted on the support plate, a typical motor 40 being shown connected to one end of a blade 38 by a rack-and-pinion drive coupling 42. Each blade 38 is operated so that its inner edge 38*a* shifts in-and-out in relation to the beam axis, resulting from equal rotation of both of its motors. Tilting motion of any one blade 38 results from unequal operation of the two motors coupled to the ends of that blade. A corner of each blade 38 overlies a corner of a neighboring blade, providing guidance from above. Loose guidance of the racks pivoted to the ends of the blades restrains the parts in the assembly shown. Consequently, the parts can undergo substantial warping due to heat without interfering with free operation of the blades.

FIG. 6 represents an iris 34 having multiple blades that can be adjusted by operating one ring 46 in relation to the other ring 48, each blade having a pivotal connection to each of the rings. Motor 50 operates one of the rings by a tensioned spring-and-cord coupling 52. Rings 46 and 48 may loosely overlie blades 44, to retain the parts in assembly over a supporting and guiding plate below the blades. That looseness of the parts is feasible because the beam former is vertical.

Referring again to FIG. 3, there are two lenses 54 and 56, movable through adjustment ranges to their dotted-line representations 54' and 56'. The first lens creates a virtual image of the beam shaper's outline and the second projects that image to the stage. The adjustment of first lens determines whether the outline is sharp or diffused; the adjustment of the second lens determines the distance to the focussed image. Both lenses must be moved to change the size of the image at the stage.

Figure 4:
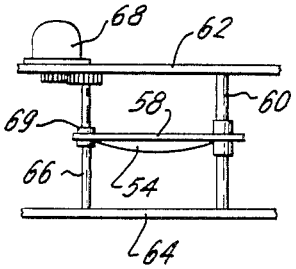
FIG. 4 is a detail of an adjusting mechanism for each lens in FIG. 3.

FIG. 4 shows lens 54 with some details of its adjustment mechanism that also typifies the mechanism for adjusting lens 56. Lens 54 is secured to a plate 58 guided on several rods 60 (only one being shown) fixed in stationary top and bottom frame plates 62 and 64. A drive screw 66 is rotated by a remotely controlled motor 68 (through gearing). Drive screw 66 mates with internally threaded follower 69 that is fixed in lens support 58, so that turning of the drive screw slides plate 58 up or down along guides 60.

The drive-screw-and-follower arrangement for adjusting the position of lens 54 is self-locking in that, after motor 68 is deenergized, the lens mount 58 stays in any adjustment to which it was operated by motor 68. Even though lens 54 and its support are not gravitationally neutral, there is no danger of the lens shifting when the adjustment motor is deenergized and provides no holding torque.

FIG. 7 illustrates mechanism for operating a blade of gate 36' as an alternative to that of FIG. 5. In FIG. 7, blade 70 is fixed to rod 72 which is captive but rotatable in a bore in block 74. The rim 70*a* of blade 70 has gear teeth, to be operated by motor 76 through a gear train including splined shaft 78 and gear 80. A slide guide 82 is guided between two side rails 84 and between a top guide block 86 and a bottom support plate (not shown) so that blade 70, block 74 and motor 76 are moved linearly as a unit. Drive screw 88 is fixed to and reciprocates slide guide 82. A remotely controlled motor 90 is fixed to stationary brackets 92. Drive screw 88 is variably projected and retracted by an internally threaded follower 94 that is rotated by motor 90. Accordingly, rotation of motor 92 causes blade 70 to shift toward and away from the beam axis, and motor 76 tilts edge 70*b* of the blade adjustably. Each of four blades of this gate has the same operating mechanism A color filter 96 (FIG. 3) is provided between lenses 54 and 56. To avoid being limited to a simple color wheel having a very modest number of discrete filters that may be selected by remote control, a very wide range of colors and color intensities can be provided by the stage lighting unit of FIG. 3. Three strips of film 96*a*, 96*b* and 96*c* overlie one another where they intercept the beam. These three strips are operable by two pairs of reels 98*a* and 98*b* and a third pair (not shown). One reel of each pair may be spring-wound, the other being motor driven under remote control. The motor-driven reel determines winding and unwinding of a strip while the spring-wound reel unwinds or winds the strip correspondingly and maintains tension in the strip. Strip 96c extends horizontally at right angles to horizontal parallel strips 96a and 96b.

As an alternative, three discs can be used having mutually overlying areas to intercept the beam, the discs having filters of colors and varying density distributions corresponding to those of the strips in FIG. 3. However, a much larger range of color choice becomes possible when strips are used, and the resulting structure is more compact.

In FIG. 3, strips 96a, b, c have mutually subtractive color-filter combinations related to one another to yield a comprehensive range of colors and hues. Each strip comprises areas of graded density varying gradually or stepwise from clear at one end to maximum-density at the other end. For example, if all three strips are graded binary color filters, strips 96a and 96b may be related so that, when overlapped, they pass red predominantly, strips 96b and 96c may be related so that, when overlapped, they pass yellow predominantly and strips 96a and 96c may be related so that, when overlapped, they pass blue predominantly. Portions of two strips having selected densities of color filter pass their common color component, predominantly, the clear area of the third strip being disposed across the beam. Varying hues can be produced using a high-density area of one strip with a lower density area of another strip, the clear area of the third overlapping the first two. The strips can be arranged so that the selected area of the third strip has significant filter density and then it will modify the resulting hue and brightness of the beam, as compared to the effect of selectively interposing significant filter densities of only two strips across the beam. Also, there may be times when the clear (or nearly clear) areas of two of the strips are disposed across the beam with a significantly dense filter area of only the third strip, and then the color and shade of the beam are determined by the third strip alone. Finally, if the clear areas of all three strips are selectively disposed across the beam, the beam retains the unfiltered spectrum of visible light from the lamp. At the opposite extreme—high density areas of all the strips across the beam—the faint output is a dark chocolate, virtually black. The filters are related so that equal density intermediate areas of all three pass an approximation of dimmed neutral-color light. Instead of using binary-color filters, strips of other subtractive-color filters may be used, e.g. magenta (red-blue) and blue-green and yellow, respectively.

In addition to the color filter strips, it is contemplated that graded-density neutral filter strips may be added, as a means for controlling the beam's brightness. Brightness of the beam for any color and hue can also be controlled by a dimmer for the lamp contained in the emote control apparatus 14. When dimmer control of brightness is used, the varied filament temperatures of incandescent lamps can be taken into account by proper choice of filter areas.

The lamp, together with the reflector and its associated devices for extracting much of the infra-red from the beam, the iris and the beam-shaping gate, the beam-focussing lenses and the color filter constitute the beam former, all of which is stationary, producing a beam along a vertical axis aimed downward. This entire beam is intercepted by mirror 20. Placing this mirror as close as practicable to the beam former assures intercepting the full cross-section of the beam without resort to a needlessly large mirror. The center of the mirror intercepts the center or axis of the beam. As the beam redirector turns about that axis (as explained above) mirror 20 turns so as to aim the beam in different directions, while maintaining the illustrated relationship of mirror 20 to beam. The direction of the beam leaving mirror 20 slants downward by a small angle, but the changes of direction of the beam resulting from rotating mirror 20 about its axis are changes in azimuth.

The segment of the beam leaving mirror 20 impinges on mirror 22 and that beam is redirected so that the segment of the beam leaving the beam former and the output beam leaving mirror 22 have axes in a common plane. This relationship is maintained despite adjustment of mirror 22 to vary the elevation of the output beam. This results from arranging the adjustment axis of mirror 22 perpendicular to the common plane containing the axes of the output beam and the beam from the beam former and of the beam reflected from the first mirror.

As previously noted, adjustment of mirror 22 about its axis is determined by a remotely controlled motor 29 (FIG. 2). Operation of motors 26 and 29 enables the beam redirector 12 to aim the downward-directed beam from the beam former selectively to a wide range of areas of the stage.

Adjustments for the lighting unit may involve as many as sixteen motors, eight of which are used for beam shaper 36 or 36'. In addition, the liquid coolant for the infra-red filter 30 involves supply and discharge tubing, which tubing can also serve for any liquid cooling chamber outside reflector 33 that might be used. The wiring from the remote control 14 to all but one of the motors and to the lamp and the liquid coolant lines extending to the lighting unit remain undisturbed in the operation of the adjustments because the beam former is stationary.

The unit which constitutes the beam redirector represents a mass that is prominently unbalanced in relation to axis I (FIG. 3) of the beam entering the redirector. However, because the rotational axis of redirector 18 is vertical, the unbalanced mass is not lifted and lowered in the course of redirecting the beam. Accordingly, motor 26 is not subjected to load peaks at times, and potential motor noise that may result from such load peaks is avoided. Perhaps more important is the stability of the beam redirector, in that it tends to remain in any adjustment to which it was moved by motor 26 despite interruption of torque when the motor is deenergized. It would be possible to add a counterbalancing mass to beam redirector 18 so that it would be balanced about its bearing axis. However, such a counterbalance would add to the mass which must be turned in changing the aim of beam redirector 18; and the increased mass involves increased inertia and consequent increased start-up and slow-down loads on the motors.

An exemplary embodiment of the invention in its various aspects has been described above and shown in the accompanying drawings. That embodiment is susceptible of changes and varied application by those skilled in the art, and certain aspects of the invention may be used without others. Consequently, the invention should be construed broadly in accordance with its true spirit and scope.

What is claimed is:

1. A stage lighting unit including a beam former for providing a beam and a beam redirector for aiming the beam from the beam former selectively to areas over a large expanse of the stage, said beam former including a lamp for providing a spectrum of visible light and a reflector for forming the light from the lamp into a beam of substantial cross-section and means for focusing the beam as a spot when projected onto a stage, said beam redirector being secured to said beam former for adjustment about the axis of the beam from the beam former, said beam redirector including a first mirror and a second mirror, said first mirror being disposed to intercept the beam from the beam former and reflect it to the second mirror, and said second mirror being arranged to reflect the beam from the first mirror as an output beam, the axes of the beam from the beam former and of the succcessively reflected portions of the beam being in a common plane, the second mirror being mounted for adjustment about an axis perpendicular to said common plane.

2. A stage lighting unit as in claim 1 wherein said beam former is mounted to emit a beam aimed downward and at least approximately vertical.

3. Stage lighting apparatus including a stage lighting unit as in claim 1, wherein said beam former has a stationary mount and includes adjustable means for shaping the outline of the beam and motors for adjusting said focussing means and said beam shaping means, said apparatus further including remote control means for said motors and connections extending to said motors from said remote control means.

4. A stage lighting unit as in claim 1, including means for mounting said beam former stationary with its beam directed downward and at least approximately vertical.

5. Stage lighting apparatus including the stage lighting unit of claim 1, said unit including respective motors for operating the beam redirector about the axis of the beam from the beam former and for operating the second mirror about said second axis, and remote control means for said motors, respectively, having connections from the remote control means to said stage lighting unit.

6. A stage lighting unit including a beam former having means for providing a beam having a broad spectrum of visible light and means for adjusting the beam characteristics, means for mounting said beam former stationary with its beam directed downward and at least approximately vertical, and a beam redirector mounted on the lower end of said beam former and adjustable about the axis of the beam emitted by the beam former for providing an azimuth beam-adjustment, said beam redirector also including adjustable means for providing an elevation beam adjustment.

7. A stage lighting unit as in claim 6, including a motor for adjustably operating the azimuth adjustment of said beam redirector, the mass of said beam redirector being unbalanced relative to said axis, the stationary and at least approximately vertical disposition of the beam former axis avoiding any tendency of said unbalanced mass to turn the beam redirector and avoiding load peaks on the motor due to the unbalanced mass.

8. A stage light unit as in claim 7 where the beam redirector includes first and second mirrors mounted for rotation in unison about said axis, said first mirror being disposed for intercepting the beam from the beam former and reflecting it to the second mirror throughout the adjustment of the beam redirector about the beam former axis, said second mirror being adjustable about an axis parallel to its reflective plane and perpendicular to a plane containing the beam former axis and the axis of the beam reflected by said first mirror.

9. Apparatus as in claim 6 wherein said beam former includes a lamp that emits both infrared and visible-light output and wherein said means for adjusting the beam characteristics includes blades disposed and adjustable at least approximately horizontally to intercept adjustable portions of the lamp's output, the blades being supported and guided from below and being free of close overlying guides, thereby to tolerate substantial heat-induced warping of the blades.

10. A stage lighting unit including a beam former for providing a formed beam directed along an axis, i. the beam former having a lamp that emits a broad spectrum of visible light and a reflector that acts with the lamp for providing a beam of substantial cross-section, the beam former also having adjustable means for shaping the outline of the formed beam and adjustable focusing means disposed along the path of said formed beam, ii. A beam redirecting unit mounted on the beam former for adjustment about the axis of the beam former's beam, said beam redirecting unit having first and second mirrors, the first mirror being disposed to intercept the broad beam from the beam former and reflect it to the second mirror and the second mirror being disposed to intercept the beam from said first mirror and said second mirror being adjustable about an axis, the axes of the beam former and the second mirror being related for directing the beam from the beam former to selected areas throughout the stage, and iii. means for operating said beam former and said beam redirector by remote control including motors in the beam former for operating said adjustable beam shaping means and said adjustable focussing means and a motor for operating said beam redirecting unit about the beam former's axis, and another motor in the beam redirecting unit for operating said second mirror about its axis.

11. A lighting unit as in claim 10 wherein said axes of the beam redirecting unit and said second mirror are related so that, when said beam former is disposed to direct its beam vertically downward to the beam redirecting unit, adjustment of the beam redirecting unit about its axis and adjustment of said second mirror about its axis provide a wide range of azimuth and elevation adjustments of the beam direction.

* * * * *